US007255381B2

(12) United States Patent
Komizo et al.

(10) Patent No.: US 7,255,381 B2
(45) Date of Patent: Aug. 14, 2007

(54) HOOK AND METHOD FOR SEPARATING WIRE HARNESS USING THE SAME

(75) Inventors: Kenichiro Komizo, Aichi-ken (JP); Hiroaki Arai, Shizuoka-ken (JP); Katsuhiro Shin, Nara-ken (JP); Takefumi Nagoshi, Nara-ken (JP); Hatsuo Tsuyama, Osaka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/017,774

(22) Filed: Dec. 22, 2004

(65) Prior Publication Data

US 2005/0287859 A1 Dec. 29, 2005

(30) Foreign Application Priority Data

Dec. 25, 2003 (JP) ..... P2003-430701
Dec. 25, 2003 (JP) ..... P2003-430708

(51) Int. Cl.
*B66C 1/48* (2006.01)

(52) U.S. Cl. ..... 294/101; 294/82.19; 294/104

(58) Field of Classification Search ..... 294/82.1, 294/82.19, 82.31, 82.33, 101, 104, 102.1, 294/102.2

See application file for complete search history.

(56) References Cited

U.S. PATENT DOCUMENTS 2,333,351 A * 11/1943 Welch ..... 294/104
2,344,644 A 3/1944 Schwan
2,618,505 A * 11/1952 Rosenbaum ..... 294/104
2,654,630 A * 10/1953 Renfroe ..... 284/104
3,178,219 A * 4/1965 Renfroe ..... 294/104
3,189,377 A * 6/1965 Gardner ..... 294/101
3,300,242 A 1/1967 Renfroe
3,336,068 A * 8/1967 Renfroe ..... 294/101
4,273,373 A * 6/1981 van de Wetering ..... 294/101
4,491,358 A * 1/1985 Choung ..... 294/101
4,938,517 A * 7/1990 Langloy ..... 294/101

FOREIGN PATENT DOCUMENTS

DE 19852858 5/2000

(Continued)

OTHER PUBLICATIONS

European Patent Office, European Search Report dated May 26, 2006, issued in counterpart Application No. 04030482.6-2316.

*Primary Examiner*—Dean J. Kramer
(74) *Attorney, Agent, or Firm*—Finnegan, Henderson, Farabow, Garrett & Dunner, L.L.P.

(57) ABSTRACT

A hook comprises a pair of hook bodies, a pair of hook portions, a movable pressing portion, an operating portion and a link unit. The hook bodies are formed of two plates disposed apart from each other, respectively. The hook portions are integrally fixed to lower ends of the hook bodies, respectively. The movable pressing portion is rotatably supported between the hook portions. The operating portion is subject to a tension load of a hoist. The link unit has one end rotatably connected to the movable pressing portion and another end rotatably connected to the operating portion. When the operating portion is pulled upward, the movable pressing portion presses a wire harness, which is hooked to the hook portion, against the hook portion.

12 Claims, 10 Drawing Sheets

FOREIGN PATENT DOCUMENTS

| | | |
|---|---|---|
| JP | 40-12977 | 5/1965 |
| JP | 49-34283 | 9/1974 |
| JP | 54-151256 | 11/1979 |
| JP | 04-32883 | 3/1992 |
| JP | 05-039188 | 2/1993 |
| JP | 283367 | 10/1998 |
| JP | 2000-207947 | 7/2000 |
| JP | 2002-337630 | 11/2002 |

* cited by examiner

HOOK AND METHOD FOR SEPARATING WIRE HARNESS USING THE SAME

CROSS REFERENCE TO RELATED APPLICATION

This application claims benefit of priority under 35 U.S.C. § 119 to Japanese Patent Application No. 2003-430701, filed on Dec. 25, 2003 and Japanese Patent Application No. 2003-430708, filed on Dec. 25, 2003, the entire contents of which are incorporated by reference herein.

BACKGROUND OF THE INVENTION

1. Field of the Invention

The present invention relates to a hook employed to separate a wire harness from a vehicle body and to a method for separating the wire harness using the same.

2. Description of the Related Art

In handling of disused automobiles, a hook employed to separate a wire harness from a vehicle body is conventionally disclosed in Japanese Patent Publication No. 2833674.

As shown in FIGS. 1 and 2, a hook 50 comprises a hook body 51, a hook portion 52, a support pin 53, an operating portion 54, a rod member 55 and a lock member 56. The U-shaped hook portion 52 to which a wire harness WH is hooked is integrally fixed to a lower end of the hook body 51. The operating portion 54 has a lower end rotatably supported by the hook body 51 via the support pin 53 and an upper end connected to a rope 60 of a hoist (not shown in FIGS. 1 and 2). The rod member 55 is integrally fixed to a lower end of the operating portion 54 and capable of approaching an end of the hook portion 52 and separating from the same. The lock member 56 locks the rod member 55 in a situation where the rod member 55 abuts against the end of the hook portion 52.

With the above configuration, as shown in FIG. 2, the wire harness WH is hooked to the hook portion 52 in a situation where the rod member 55 separates from the end of the hook portion 52. After hooking the wire harness WH to the hook portion 52, a tension load is applied to the hook 50 via the rope 60 upward. When the operating portion 54 is rotated around the support pin 53 by the tension load, the rod member 55 is also rotated together and then abuts against the end of the hook portion 52. In this situate, the lock member 56 locks the rod member 55 so as to keep in this position. If the tension load is further applied to the hook 50 via the rope 60 upward, the wire harness WH moves upward with the hook 50. The wire harness WH is separated from a vehicle body (not shown in FIGS. 1 and 2) by forcibly pulling out the wire harness WH from a plurality of clip means (not shown in FIGS. 1 and 2) of the vehicle body with the tension load.

The rod member 55 prevents the wire harness WH from falling off an opening of the hook portion 52 because the rod member 55 closes the opening.

The plurality of clip means are divided into a right clip means group and a left clip means group around a place where the wire harness WH is hooked to the hook 50. The wire harness WH is rarely pulled out from the right and left clip means groups at the same time and usually pulled out from either the right clip means group or the left clip means group in first, when the tension load is applied to the hook 50. Therefore, external force occurs to the wire harness WH by one clip means group continuing to clip the wire harness WH wherein the external force acts in an axial direction of the wire harness WH.

If the external force occurs to the wire harness WH, the hook 50 tends to sideslip because the wire harness WH is only hooked to the hook portion 52 so as not to fall off the opening of the hook portion 52. Once the hook 50 sideslip on the wire harness WH, the tension load applied to the hook 50 is not efficiently transmitted to the wire harness WH, and accordingly it takes a lot of time to separate the wire harness WH from the vehicle body.

Further, if the hook 50 sideslip on the wire harness WH, the wire harness WH tends to slip through the hook 50 from the other clip means group side wherein the wire harness WH has been pulled out from the other clip means group. Once the wire harness WH slips through the hook 50, it is necessary to start a work for hooking the wire harness WH to the hook portion 52 from the beginning again, and accordingly it takes a lot of time and becomes complicated to separate the wire harness WH from the vehicle body.

A method for separating a wire harness using a hook is conventionally disclosed in Japanese Patent Provisional Publication 2000-207947.

As shown in FIG. 3, a part of a wire of a wire harness WH' is bent to form an eye portion 70. With the above configuration, if a hook (not shown in FIG. 3) is hooked to the eye portion 70 and then the wire harness WH' is separated from a vehicle body (not shown in FIG. 3), the hook does not sideslip on the wire harness WH'. However, since it is necessary to form the eye portions 70 on each wire harness WH' mounted to the vehicle body, it becomes complicated and costs a lot of money to manufacture the wire harness WH', and accordingly this is not practical for the method.

SUMMARY OF THE INVENTION

The object of the present invention is to provide a hook capable of separating a wire harness from a vehicle body quickly and certainly and a method for separating the wire harness using the hook.

In order to achieve the above object, the present invention provides a hook comprising a hook body, a hook portion integrally fixed to a lower end of the hook body, a movable pressing portion rotatably supported to an upper end of the hook portion, a link unit having a first end rotatably connected to the movable pressing portion and an operating portion rotatably connected to a second end of the link unit, wherein if the operating portion is pulled upward, the movable pressing portion presses a wire harness, which is hooked to the hook portion, against the hook portion.

According to the present invention, a tension load is applied to a wire harness in a situation where the wire harness is sandwiched between a hook portion and a movable pressing portion. Therefore, a sideslip of a hook is certainly prevented, even if external force acts in an axial direction of the wire harness. As a result, the wire harness is quickly and certainly pulled out from a vehicle body.

In order to achieve the above object, the present invention provides a method for separating a wire harness using a hook comprising the steps of, disposing a movable pressing portion on an upper side of a hook portion, hooking a wire harness mounted to a vehicle body to the hook portion, pulling an operating portion upward wherein the movable pressing portion presses the wire harness against the hook portion and moving the hook upward wherein the wire harness is forcibly pulled out from the vehicle body.

According to the present invention, a tension load is applied to a wire harness in a situation where the wire harness is sandwiched between a hook portion and a movable pressing portion. Therefore, a sideslip of a hook is certainly prevented, even if external force acts in an axial direction of the wire harness. As a result, the wire harness is quickly and certainly pulled out from a vehicle body.

DESCRIPTION OF THE PROFFERED EMBODIMENT

First Embodiment

Figure 1:
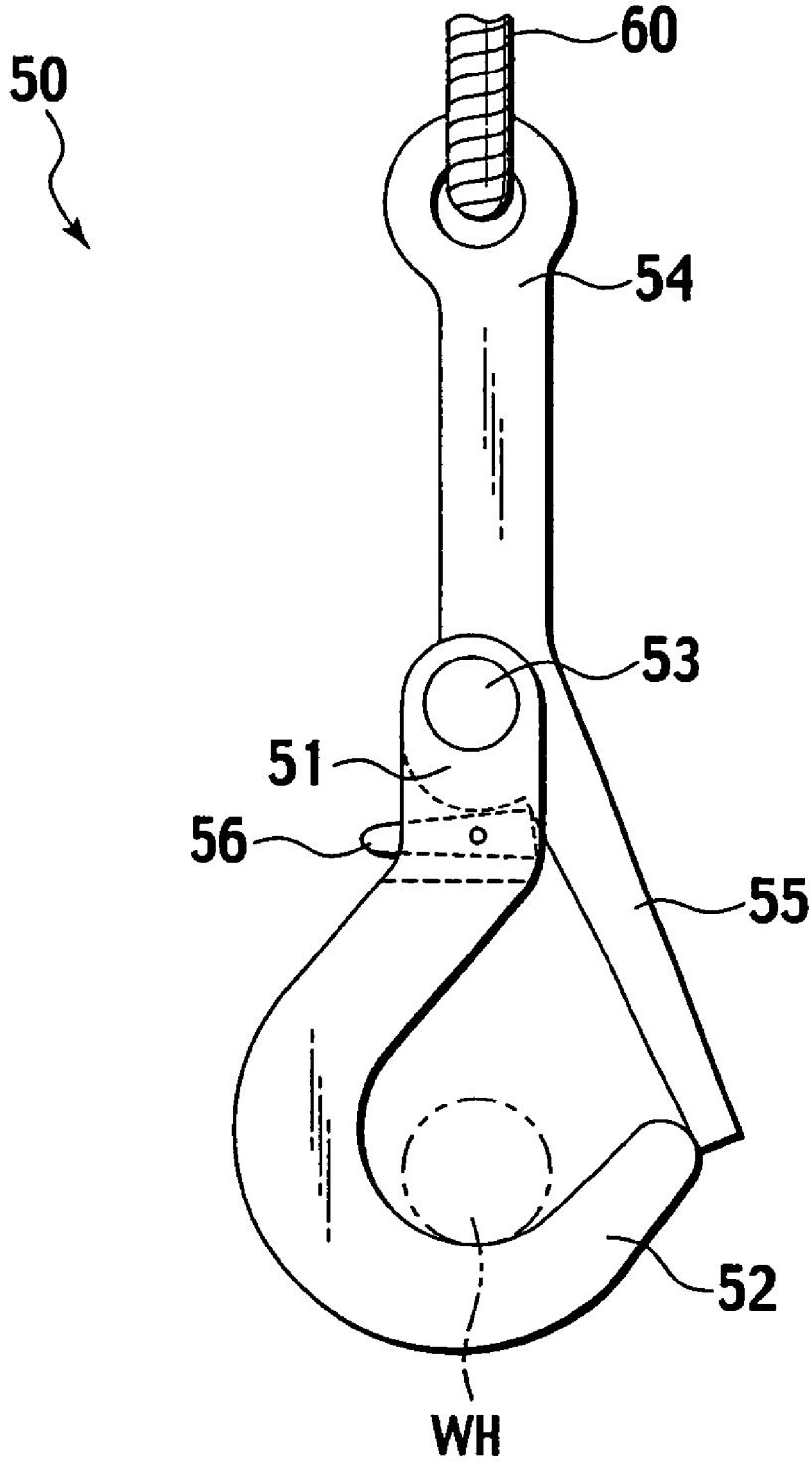
FIG. 1 PRIOR ART
FIG. 1 is a side view of a conventional hook in a state of raising a wire harness by using the hook.
Figure 2:
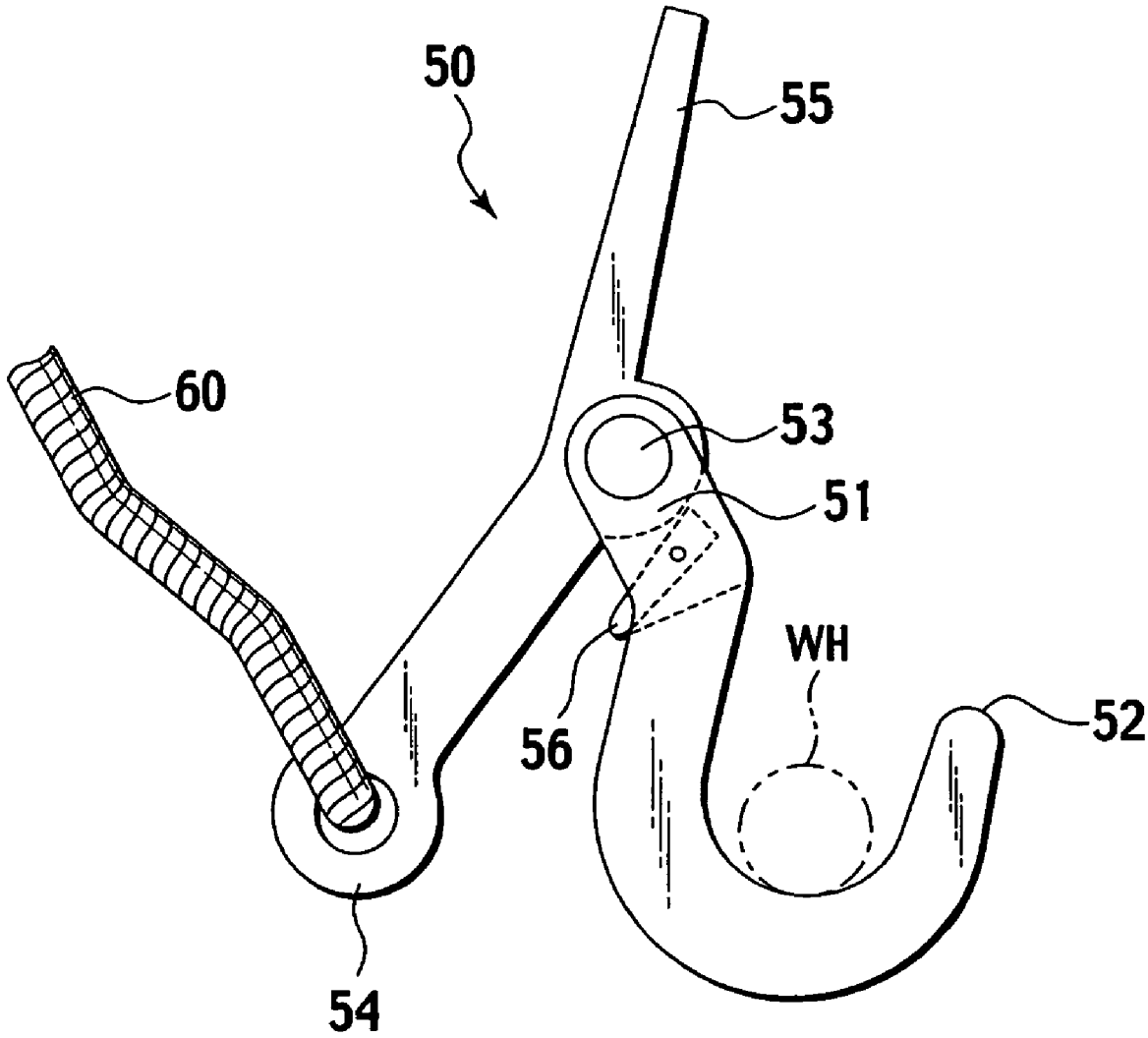
FIG.2 PRIOR ART
FIG. 2 is a side view of the conventional hook in a state of hooking the wire harness to the hook
Figure 3:
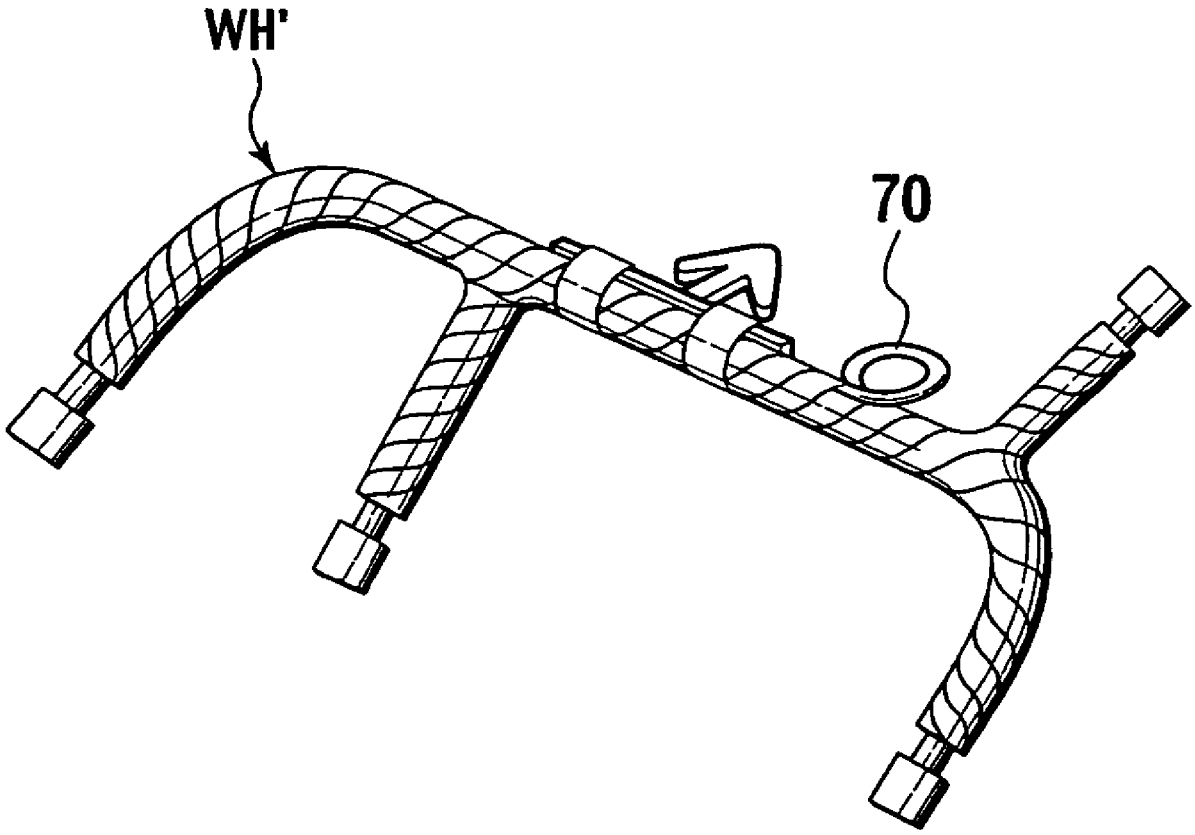
FIG.3 PRIOR ART
FIG. 3 is a perspective view of a conventional wire harness in a state of forming an eye portion.
Figure 4:
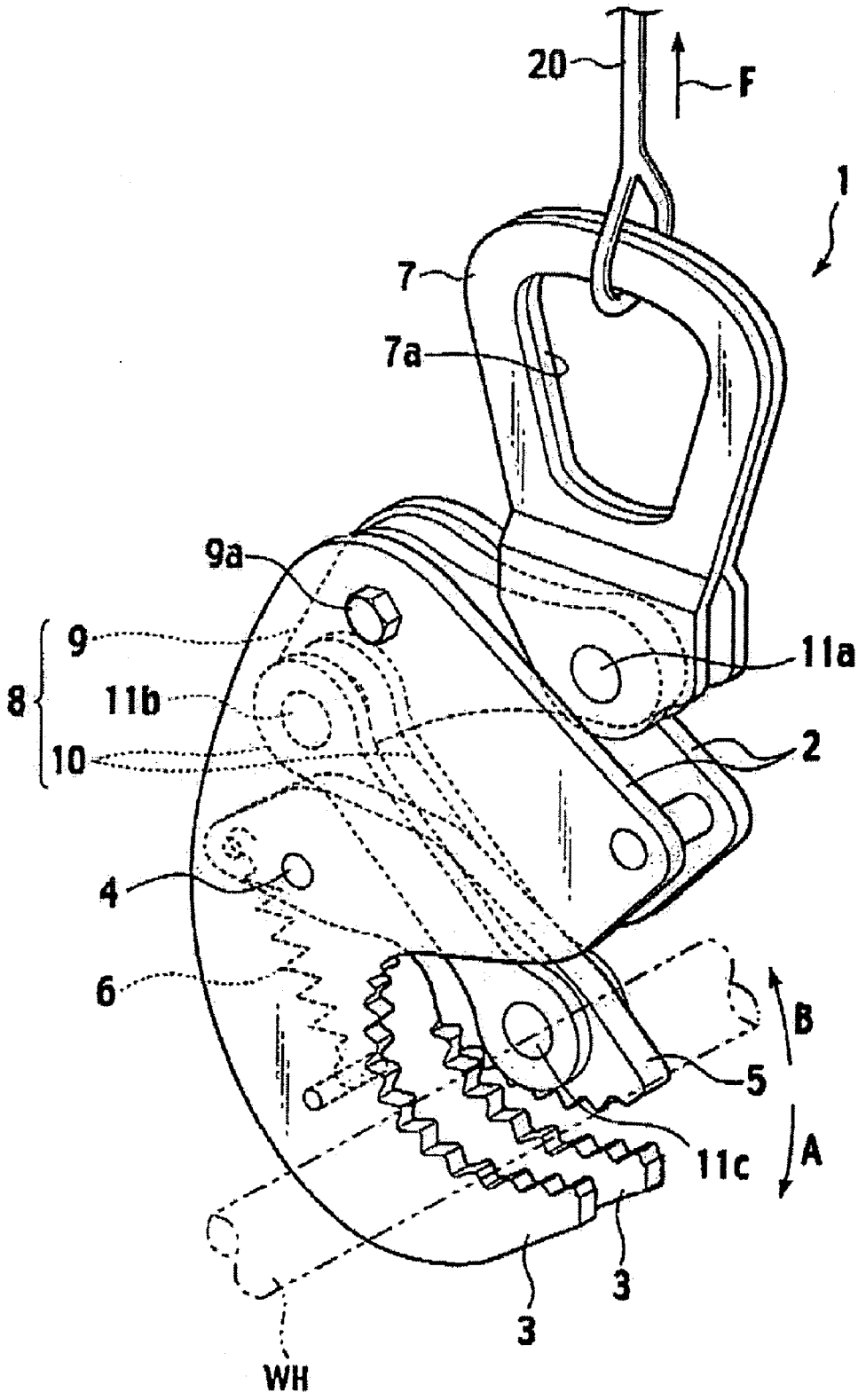
FIG. 4 is a perspective view of a hook according to a first embodiment of the present invention.

As shown in FIG. 4, a hook 1 comprises pair of hook bodies 2, a pair of hook portions 3, a support pin 4, a movable pressing portion 5, a coil spring 6, an operating portion 7 and a link unit 8.

The hook bodies 2, 2 are formed of two plates disposed apart from each other, respectively. The hook portions 3, 3 are integrally fixed to lower ends of the hook bodies 2, 2 respectively. The movable pressing portion 5 is substantially formed of a straight elongated-shape and rotatably supported between the hook portions 3, 3 via the support pin 4 on a first end side thereof. The coil spring 6 has both ends engaged to the first end of the movable pressing portion 5 and a bar which is fixed between the hook portions 3, 3, respectively. The operating portion 7 is subject to a tension load F of a hoist (not shown in FIGS. 4 to 6) via a chain 20 of the hoist. The link unit 8 has both ends connected to the movable pressing portion 5 and the operating portion 7, respectively and transmits travel distance of the operating portion 7 to the movable pressing portion 5.

The hook portions 3, 3 are substantially formed of J-letter shapes, respectively and arranged parallel to and apart from each other. Each of the hook portions 3, 3 contacts a wire harness WH from below and has an uneven and concave upper surface.

The movable pressing portion 5 contacts the wire harness WH from above and has an uneven and convex lower surface. The movable pressing portion 5 abuts against the wire harness WH which is placed on the upper surfaces of the hook portions 3, 3, by rotating it around the support pin 4 in an A direction. Thus, the wire harness WH is sandwiched between the hook portions 3, 3 and the movable pressing portion 5.

Figure 5:
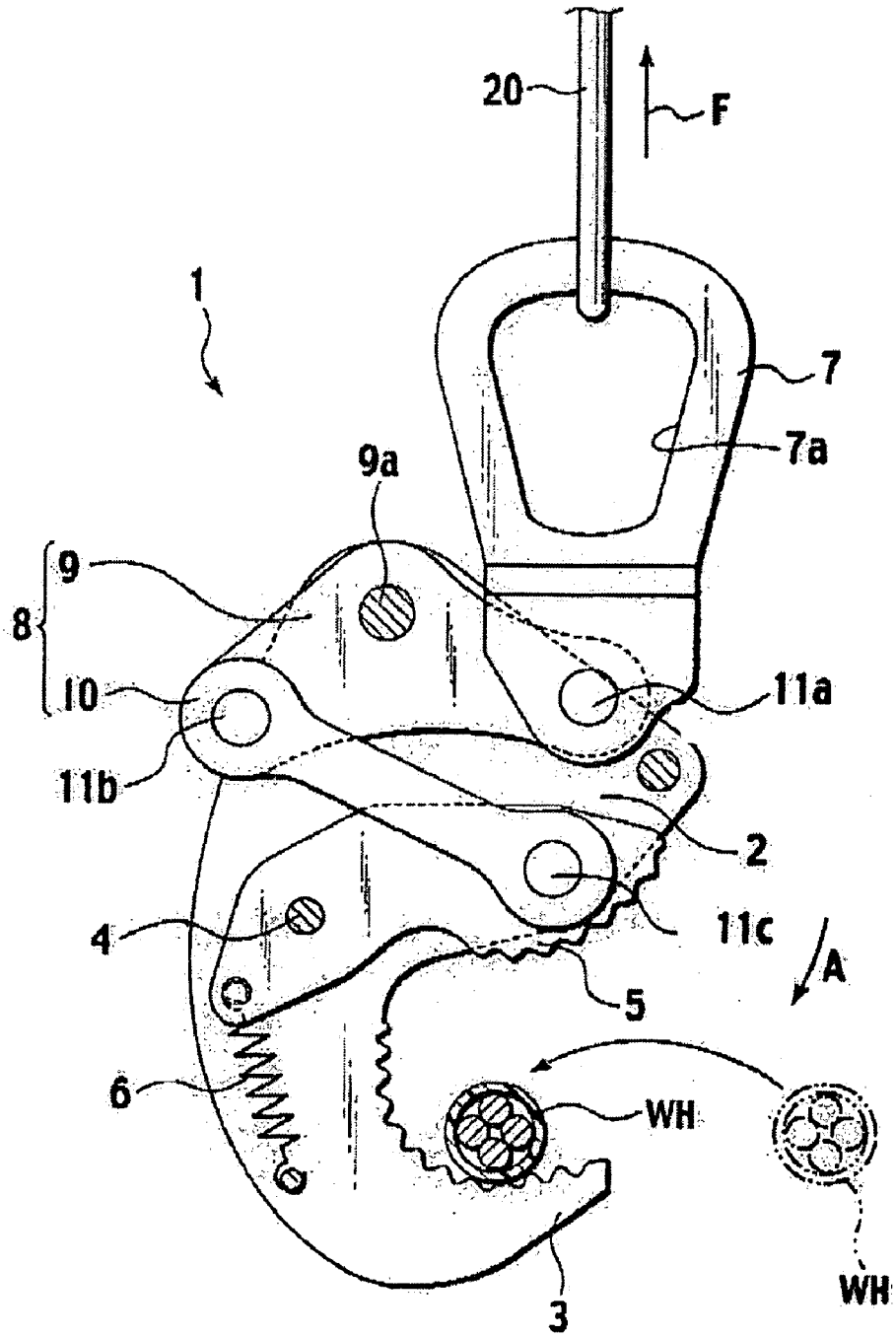
FIG. 5 is a side view of the hook in a state of hooking a wire harness to the hook according to a first embodiment of the present invention.
Figure 6:
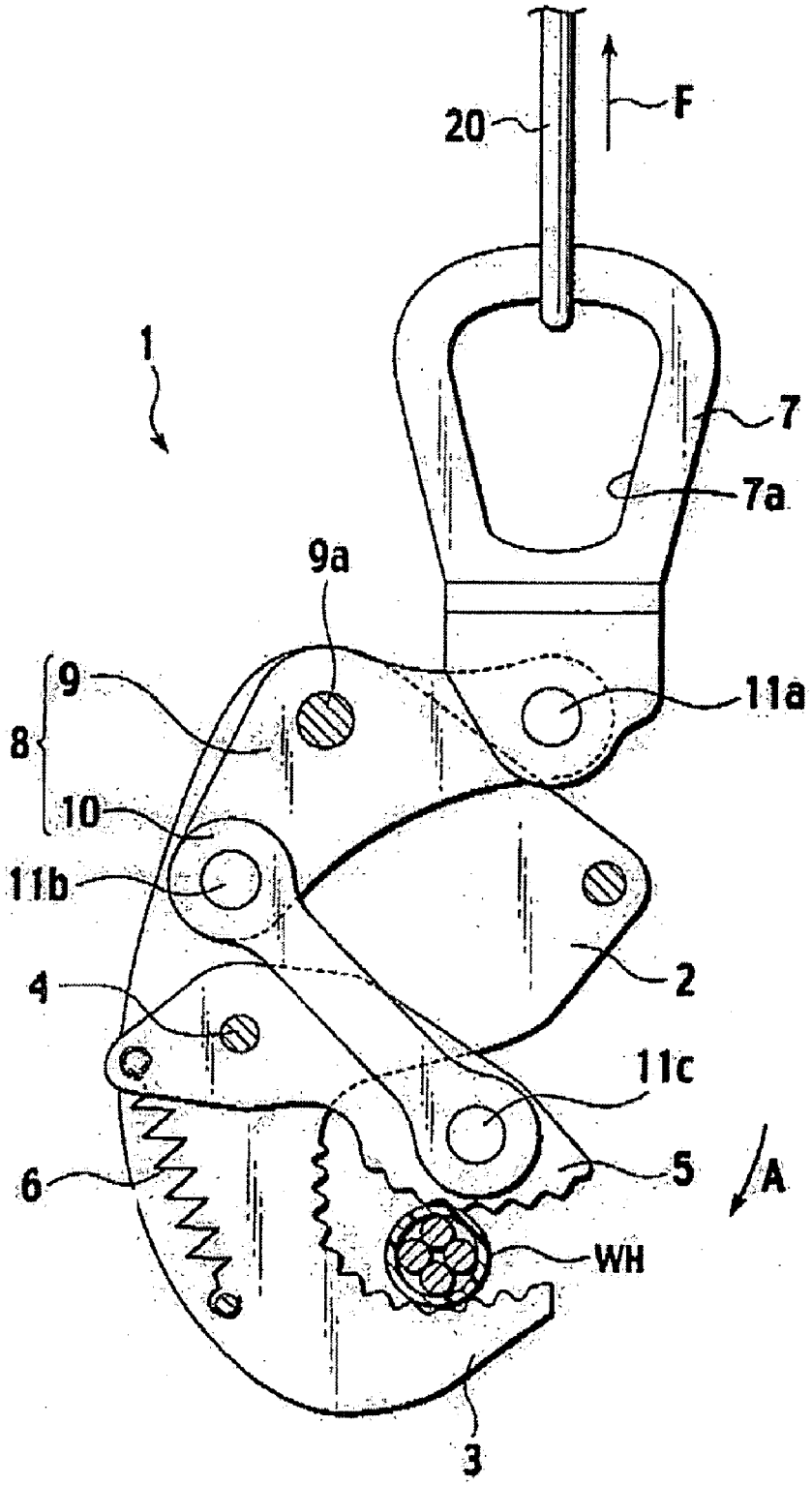
FIG. 6 is a side view of the hook in a state of sandwiching the wire harness between a movable pressing portion and hook portions according to a first embodiment of the present invention.

The coil spring 6 biases the movable pressing portion 5 in a B direction. As shown in FIG. 5, the movable pressing portion 5 is located on an upper side of a space between the hook portions 3, 3 (a waiting position) in a situation where the tension load F is not applied to the operating portion 7.

The operating portion 7 has an engaging hole portion 7*a* to which an end of the chain 20 is engaged. When the operating portion 7 is subjected to the tension load F from the chain 20, the operating portion 7 moves in a direction where it separates from the hook bodies 2, 2.

The link unit 8 has a first link member 9 and a pair of second link members 10. The first link member 9 is substantially formed of a triangular shape and rotatably supported between upper ends of the hook bodies 2, 2 via a support pin 9*a* on a center position thereof. Also, the first link member 9 has a first end which is rotatably supported to a lower end of the operating portion 7 via a first pin 11*a*. The second link members 10, 10 are formed of a straight elongated-shape and have first ends which are rotatably supported to both sides of a second end of the first link member 9 via a second pin 11*b*, and second ends which are rotatably supported to both sides of a second end of the movable pressing portion 5 via a third pin 11*c*.

If the operating portion 7 moves upwards by the tension load F, the travel distance of the operating portion 7 is transmitted to the movable pressing portion 5 via the first link member 9 and the second link members 10, 10. Then, the movable pressing portion 5 rotates in the A direction against a bias force of the coil spring 6.

Next, a method for separating the wire harness WH from a vehicle body (not shown in FIGS. 4 to 6) using the hook 1 will be described.

First, the movable pressing portion 5 is located in the waiting position by the biasing force of the coil spring 6 (see FIG. 5). Secondly, the wire harness WH is hooked to the hook portions 3, 3. Thirdly, the tension force F is applied to the operating portion 7 via the chain 20. When the tension force F is applied to the operating portion 7, the operating portion 7 moves upwards. Here, the travel distance is transmitted to the movable pressing portion 5 via the link unit 8, which rotates the movable pressing portion 5 in the A direction. The movable pressing portion 5 rotates and then abuts against the upper surface of the wire harness WH to press the wire harness WH against the hook portions 3, 3 downwards. Thus, the wire harness WH is sandwiched between the hook portions 3, 3 and the movable pressing portion 5 (see FIG. 6).

Finally, the tension force F is further applied to the operating portion 7 via the chain 20, which moves the hook 1 upwards and pulls the wire harness WH upwards at the same time. The tension force F forcibly pulls out the wire harness WH form a clip means (not shown in FIGS. 4 to 6) of the vehicle body.

The hook 1 according to the present embodiment is characterized by the following.

It is hard to occur a sideslip of the hook 1 on the wire harness WH, even if external force acts in an axial direction of the wire harness WH by pulling out the wire harness WH from either a right or a left clip means group in first. Therefore, the wire harness WH is quickly and certainly pulled out from the vehicle body.

Shearing force acts on the wire harness WH to sandwich the wire harness WH in a bending state because the wire harness WH is sandwiched between the hook portions 3, 3 and the movable pressing portion 5 disposed between the hook portions 3, 3. Therefore, sandwiching force of the hook 1 strengthens against the external force acting in the axial direction of the wire harness WH. As a result, the sideslip of the hook 1 is certainly prevented, even if the external force acts in the axial direction of the wire harness WH.

If the hook 1 is released from the tension load F, the movable pressing portion 5 leaves the wire harness WH quickly because the coil spring 6 biases the movable pressing portion 5 in a direction of being away the upper surface of the hook portions 3, 3. Therefore, works of pulling out the wire harness WH from a vehicle body and hooking the wire harness WH to the hook 1 in a next step are easily performed.

Frictional resistance between the wire harness WH and the hook portions 3, 3 and between the wire harness WH and the movable pressing portion 5 increases because the upper surfaces of the hook portions 3, 3 and the lower surface of the movable pressing portion 5 are uneven. Therefore, the sideslip of the hook 1 is certainly prevented.

Next, modifications of the present embodiment will be described.

Although the link unit 8 is composed of three members such as the first link member 9 and the second link members 10, 10, the link unit 8 may be composed of one member or members being more than three.

Figure 10:
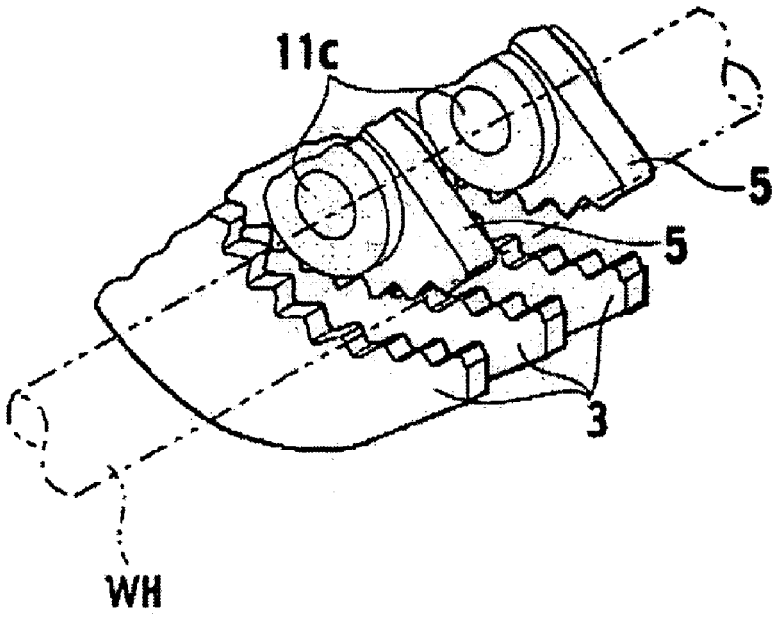
FIG. 10 is a side view of the hook in a state of sandwiching the wire harness between a plurality of movable pressing portions and a plurality of hook portions according to a first embodiment of the present invention.

Although the hook portion 3 is composed of two parts, the hook portion 3 may be composed of parts being equal to and more than three and then each movable pressing portion 5 may be disposed between adjacent hook portions 3, 3, as shown in FIG. 10.

Although the bias means is coil spring 6, the bias means may be a means capable of biasing the movable pressing portion 5 in the B direction.

Although the upper surfaces of the hook portions 3, 3 and the lower surface of the movable pressing portion 5 are formed of unevenness, either the upper surfaces or the lower surface may be only formed of unevenness.

Second Embodiment

Figure 7:
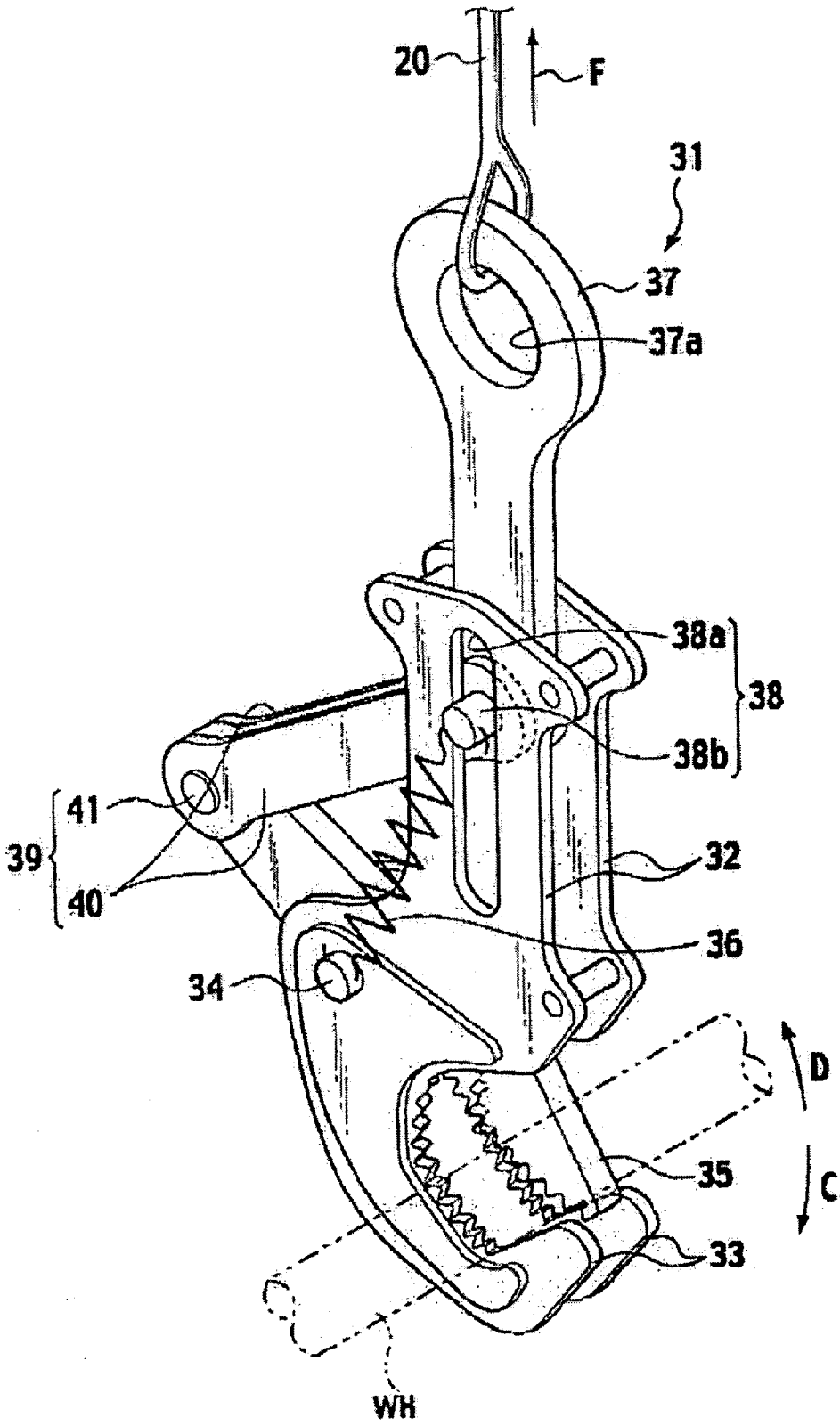
FIG. 7 is a perspective view of a hook according to a second embodiment of the present invention.

As shown in FIG. 7, a hook 31 comprises a pair of hook bodies 32, a pair of hook portions 33, a support pin 34, a movable pressing portion 35, a pair of coil springs 36 (one of the pair of coil springs 36 is shown in FIG. 7), an operating portion 37, a pair of guide members 38 (one of the pair of guide members 38 is shown in FIG. 7) and a link unit 39.

The hook bodies 32, 32 are formed of two plates disposed apart from each other, respectively. The hook portions 33, 33 are integrally fixed to lower ends of the hook bodies 32, 32 respectively. The movable pressing portion 35 is substantially formed of a straight elongated-shape and rotatably supported between the hook portions 33, 33 via the support pin 34 at a central part thereof. Each of the coil springs 36, 36 has both ends engaged to the support pin 34 and the guide member 38, respectively. The operating portion 37 is subject to a tension load F of a hoist (not shown in FIGS. 7 to 9) via a chain 20 of the hoist. The guide members 38, 38 are provided on the hook bodies 32, 32 along a longitudinal direction of the hook bodies 32, 32, respectively. The link unit 39 has both ends connected to the movable pressing portion 35 and the operating portion 37, respectively and transmits travel distance of the operating portion 37 to the movable pressing portion 35.

The hook portions 33, 33 are substantially formed of J-letter shapes, respectively and arranged parallel to and apart from each other. Each of the hook portions 33, 33 contacts a wire harness WH from below and has an uneven and concave upper surface.

The movable pressing portion 35 contacts the wire harness WH from above and has an uneven and convex lower surface. The movable pressing portion 35 abuts against the wire harness WH which is placed on the upper surfaces of the hook portions 33, 33, by rotating it around the support pin 34 in a C direction. Thus, the wire harness WH is sandwiched between the hook portions 33, 33 and the movable pressing portion 35.

The operating portion 37 has an engaging hole portion 37*a* to which an end of the chain 20 is engaged, on an upper end thereof. When the operating portion 37 is subjected to the tension load F from the chain 20, the operating portion 37 moves in a direction where it separates from the hook bodies 32, 32.

Each of the guide members 38, 38 has a guide groove 38*a* and guide pin 38*b*. The guide groove 38*a* is formed on central region of the hook body 32 and extends along the longitudinal direction of the hook body 32. The guide pin 38*b* is provided in a protruding condition to one surface of the lower end of the operating portion 37 and guided by the guide groove 38*a*. If the tension force F is applied to the operating portion 37 via the chain 20, the operating portion 37 is guided by the guide grooves 38*a*, 38*a* via the guide pins 38*b*, 38*b* to move toward the upper ends of the hook bodies 32, 32.

The link unit 39 has a pair of link members 40 and a pin 41. Each of the line-shaped link members 40, 40 has a first end rotatably connected to the lower end of the operating portion 37 via guide pin 38*b* and a second end rotatably connected to a first end of the movable pressing portion 35 via the pin 41. If the tension load F is applied to the operating portion 37, the operating portion 37 moves toward the upper ends of the hook bodies 32, 32. At this time, the travel distance of the operating portion 37 is transmitted to the movable pressing portion 35 via the link unit 39, which rotates the movable pressing portion 35 in the C direction against biasing force of the coil springs 36, 36.

Figure 8:
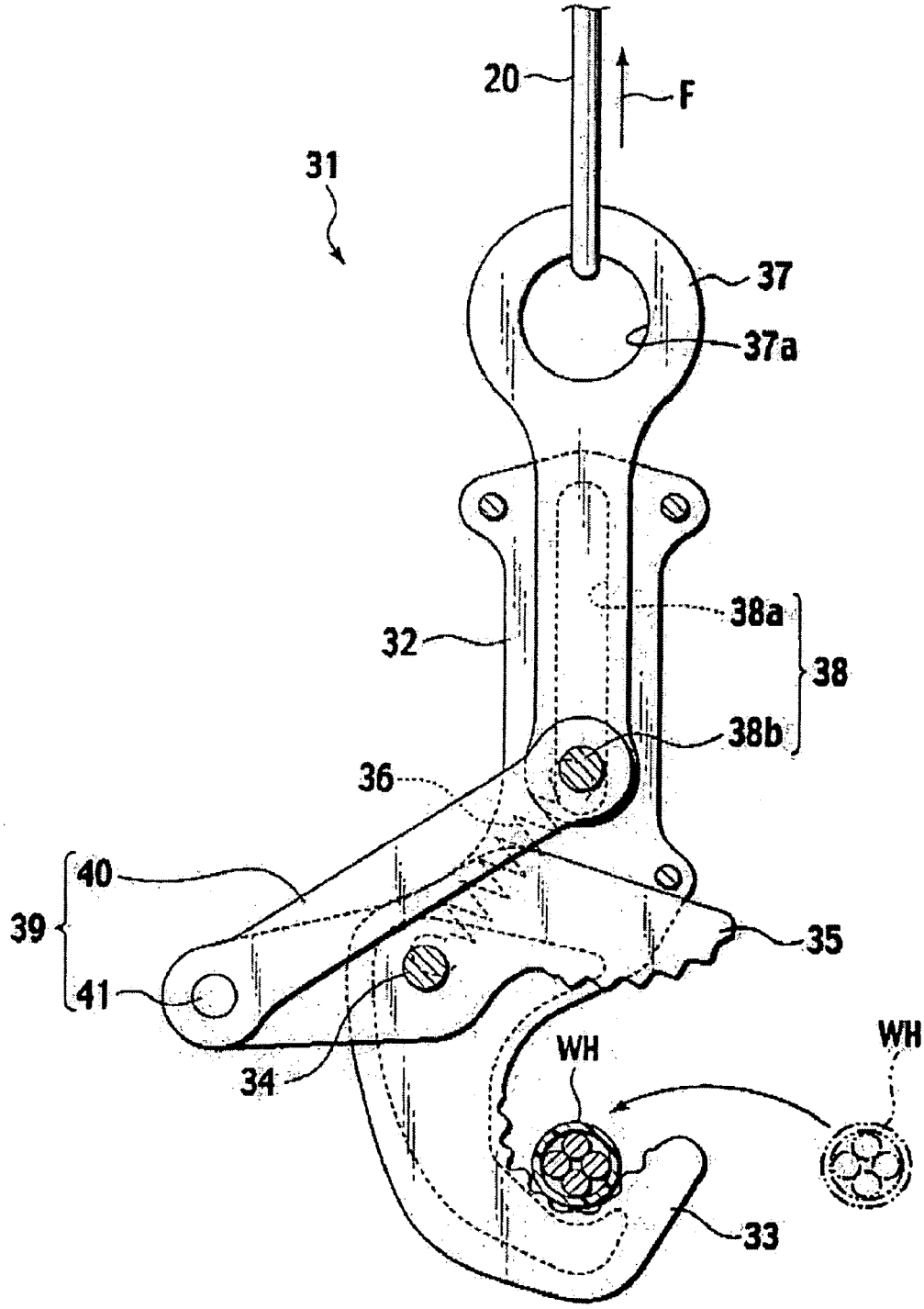
FIG. 8 is a side view of the hook in a state of hooking a wire harness to the hook according to a second embodiment of the present invention.
Figure 9:
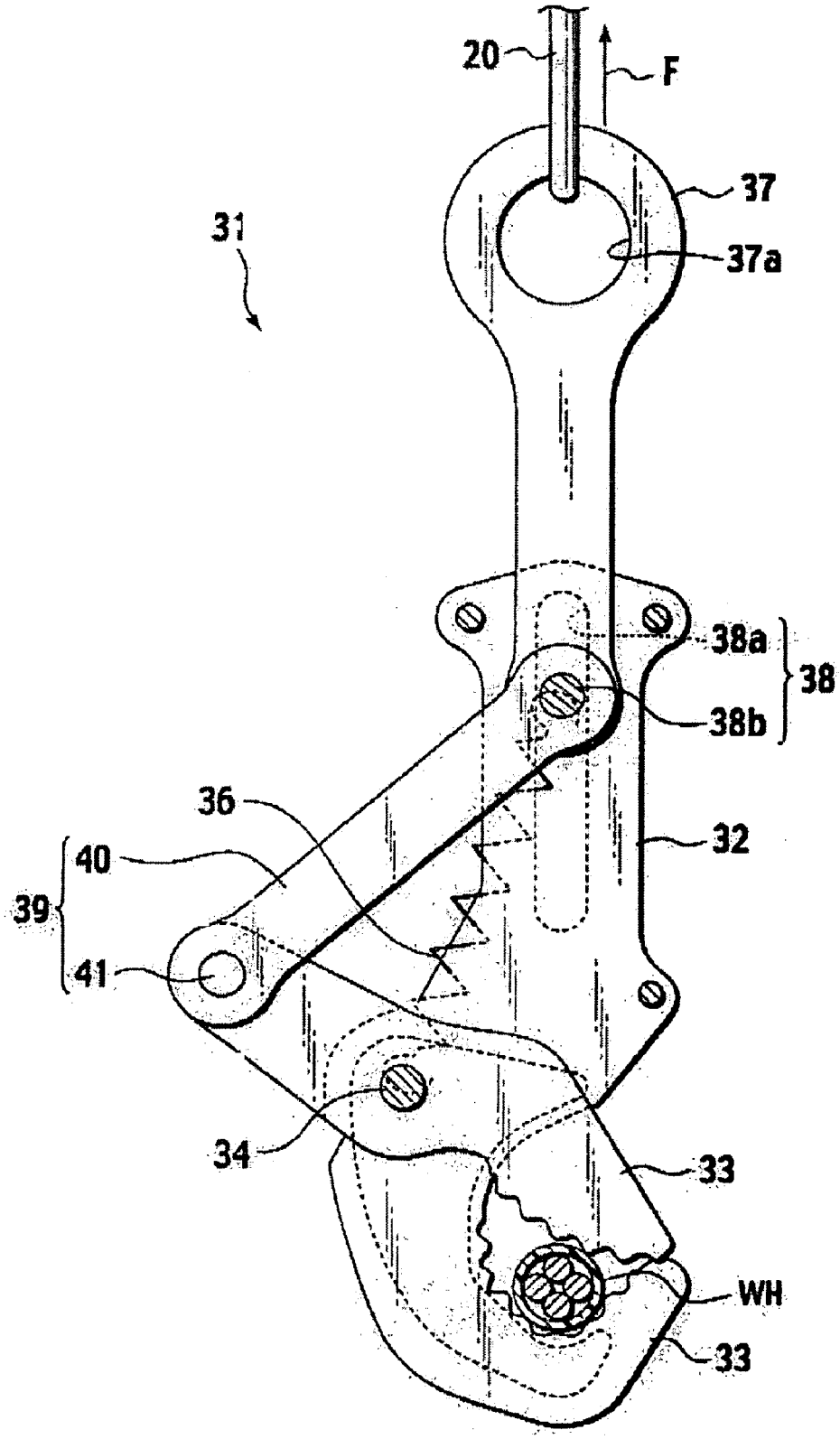
FIG. 9 is a side view of the hook in a state of sandwiching the wire harness between a movable pressing portion and hook portions according to a second embodiment of the present invention.

Each of the coil springs 36, 36 has one end engaged to the support pin 34 and another end engaged to the guide pin 38*b*, respectively, and biases the guide pin 38*b* toward the lower end of the guide groove 38*a*. As shown in FIG. 8, each of the guide pins 38*b*, 38*b* is located on the lower end side of the hook body 32, which allows the movable pressing portion 35 to be located on an upper side of a space between the hook portions 33, 33 (a waiting position) in a situation where the tension load F is not applied to the operating portion 37.

Next, a method for separating the wire harness WH from a vehicle body (not shown in FIGS. 4 to 6) using the hook 31 will be described.

First, the movable pressing portion 35 is located in the waiting position by the biasing force of the coil springs 36, 36 (see FIG. 8). Secondly, the wire harness WH is hooked to the hook portions 33, 33. Thirdly, the tension force F is applied to the operating portion 37 via the chain 20. When the tension force F is applied to the operating portion 37, the operating portion 37 moves upwards while being guided by the guide members 38, 38. Here, the travel distance is transmitted to the movable pressing portion 35 via the link unit 39, which rotates the movable pressing portion 35 in the C direction. The movable pressing portion 35 rotates and then abuts against the upper surface of the wire harness WH to press the wire harness WH against the hook portions 33, 33 downwards. Thus, the wire harness WH is sandwiched between the hook portions 33, 33 and the movable pressing portion 35 (see FIG. 9).

Finally, the tension force F is further applied to the operating portion 37 via the chain 20, which moves the hook 31 upwards and pulls the wire harness WH upwards at the same time. The tension force F forcibly pulls out the wire harness WH form a clip means (not shown in FIGS. 4 to 6) of the vehicle body.

The hook 31 according to the present embodiment is characterized by the following.

It is hard to occur a sideslip of the hook 31 on the wire harness WH, even if external force acts in an axial direction of the wire harness WH by pulling out the wire harness WH from either a right or a left clip means group in first. Therefore, the wire harness WH is quickly and certainly pulled out from the vehicle body.

Shearing force acts on the wire harness WH to sandwich the wire harness WH in a bending state because the wire harness WH is sandwiched between the hook portions 33, 33 and the movable pressing portion 35 disposed between the hook portions 33, 33. Therefore, sandwiching force of the hook 31 strengthens against the external force acting in the axial direction of the wire harness WH. As a result, the sideslip of the hook 31 is certainly prevented, even if the external force acts in the axial direction of the wire harness WH.

If the hook 31 is released from the tension load F, the movable pressing portion 35 leaves the wire harness WH quickly because the coil springs 36, 36 bias the movable pressing portion 35 in a direction of being away the upper surface of the hook portions 33, 33. Therefore, works of pulling out the wire harness WH from a vehicle body and hooking the wire harness WH to the hook 31 in a next step are easily performed.

Frictional resistance between the wire harness WH and the hook portions 33, 33 and between the wire harness WH and the movable pressing portion 35 increases because the upper surfaces of the hook portions 33, 33 and the lower surface of the movable pressing portion 35 are uneven. Therefore, the sideslip of the hook 31 is certainly prevented.

If the tension load F is applied to the operating portion 37, the operating portion 37 moves on the hook bodies 32, 32 in a straight line. Therefore, the travel distance of the operating portion 37 is efficiently transmitted to the movable pressing portion 35 via the link unit 39 because the operating portion 37 stably moves. As a result, the tension load F efficiently acts on the wire harness WH.

The hook 31 is easily manufactured because each of the guide members 38, 38 is composed of the guide groove 38*a* and the guide pin 38*b*.

Further, The hook 31 is easily manufactured because the link unit 39 is composed of the link members 40, 40 and the pin 41.

Next, modifications of the present embodiment will be described.

Although the link member 40 of the link unit 39 is composed of two parts, the link member 40 may be composed of one part and parts being equal to and more than three.

Figure 11:
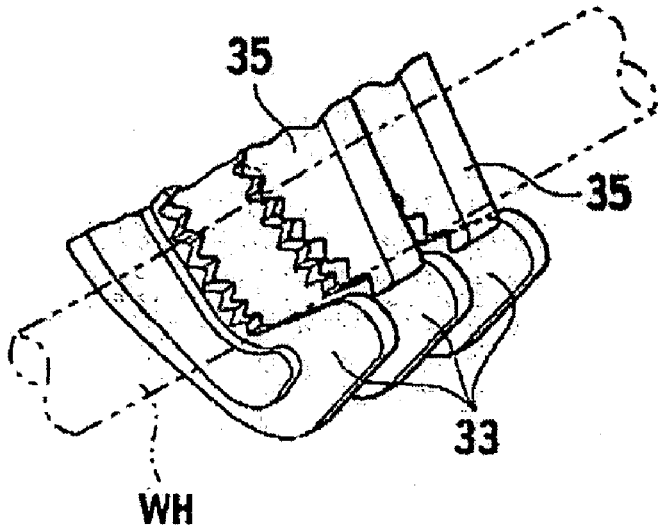
FIG. 11 is a side view of the hook in a state of sandwiching the wire harness between a plurality of movable pressing portions and a plurality of hook portions according to a second embodiment of the present invention.

Although the hook portion 33 is composed of two parts, the hook portion 33 may be composed of parts being equal to and more than three and then each movable pressing portion 35 may be disposed between adjacent hook portions 33, 33, as shown in FIG. 11.

Although the bias means is coil springs 36, 36, the bias means may be a means capable of biasing the movable pressing portion 35 in a D direction.

Although the upper surfaces of the hook portions 33, 33 and the lower surface of the movable pressing portion 35 are formed of unevenness, either the upper surfaces or the lower surface may be only formed of unevenness.

What is claimed is:

1. A hook, comprising:

a hook body;

a hook portion integrally fixed to a lower end of the hook body;

a movable pressing portion rotatably supported to an upper end of the hook portion;

an operating portion;

a guide means for guiding the operating portion along a longitudinal direction of the hook body;

a link unit having a first end rotatably connected to the movable pressing portion and a second end rotatably connected to the operating portion; and a biasing means having one end attached to the guide means and another end attached to the hook body, wherein when the operating portion is pulled upward, the movable pressing portion rotates against a biasing force of the biasing means and presses a wire harness, which is hooked to the hook portion, against the hook portion.

2. The hook according to claim 1, wherein the hook portion includes a plurality of hook portions disposed apart from one another, and wherein the movable pressing portion includes a plurality of the movable pressing portions, each of the movable pressing portions being disposed between adjacent hook portions.

3. The hook according to claim 1, wherein the hook portion has an uneven surface which contacts the wire harness.

4. The hook according to claim 1, wherein the movable pressing portion has an uneven surface which contacts the wire harness.

5. The hook according to claim 1, wherein the guide means has a guide groove formed on the hook body along the longitudinal direction of the hook body, and a guide pin guided by the guide groove and provided in a protruding condition to a lower end of the operating portion.

6. The hook according to claim 5, wherein the link unit has the first end rotatably connected to the movable pressing portion via a pin and the second end rotatably connected to the operating portion via the guide pin.

7. A hook, comprising:

a hook body;

a hook portion integrally fixed to a lower end of the hook body;

a movable pressing portion rotatably supported to an upper end of the hook portion;

an operating portion;

a biasing means having one end attached to the movable pressing portion and another end attached to the hook body; and a link unit having a first link member and a second link member, wherein when the operating portion is pulled upward, the movable pressing portion rotates against a biasing force of the biasing means and presses a wire harness, which is hooked to the hook portion, against the hook portion.

8. The hook according to claim 7, wherein the first link member includes a first end rotatably connected to the operating portion, a second end rotatably connected to the second link member, and a central portion rotatably supported by the hook body, and wherein the second link member includes a first end rotatably connected to the second end of the first link member, and a second end rotatably connected to the movable pressing portion.

9. The hook according to claim 8, wherein the first end of the first link member is rotatably connected to the operating portion via a first pin, the second end of the first link member is rotatably connected to the second link member via a second pin, and the central portion of the first link member is rotatably supported by the hook body via a support pin, and wherein the first end of the second link member is rotatably connected to the first link member via the second pin, and the second end of the second link member is rotatably connected to the movable pressing portion via a third pin.

10. The hook according to claim 7, wherein the first link member is formed of a substantially triangular shape, and the second link member is formed of a substantially straight elongated-shape.

11. The hook according to claim 7, wherein the hook portion has an uneven surface which contacts the wire harness.

12. The hook according to claim 7, wherein the movable pressing portion has an uneven surface which contacts the wire harness.

* * * * *